US005866839A

United States Patent [19]

Ohayon

[11] Patent Number: 5,866,839

[45] Date of Patent: Feb. 2, 1999

[54] HIGH PERFORMANCE ARMOR PROTECTION SYSTEM FOR TANK CREWS AND FIGHTING VEHICLES

[76] Inventor: Shalom Ohayon, 6618 (20th) Ave., Brooklyn, N.Y. 11204

[21] Appl. No.: 578,338

[22] Filed: Dec. 26, 1995

Related U.S. Application Data

[63] Continuation-in-part of Ser. No. 215,754, Mar. 21, 1994, abandoned.

[51] Int. Cl.[6] ..... F41H 7/04

[52] U.S. Cl. ..... 89/36.08; 89/36.02; 89/36.13

[58] Field of Search ..... 89/36.02, 36.08, 89/36.07, 36.09, 36.11, 36.12, 36.13; 109/49.5

[56] References Cited

U.S. PATENT DOCUMENTS

| | | | |
|---|---|---|---|
| 1,463,498 | 7/1923 | Burgess | 89/36.02 |
| 2,738,297 | 3/1956 | Pfistershammer | 154/52.5 |
| 3,431,818 | 3/1969 | King | 89/36.02 |
| 3,563,836 | 2/1971 | Dunbar | 89/36.02 |
| 3,776,094 | 12/1973 | Gilles et al. | 109/49.5 |
| 4,398,446 | 8/1983 | Pagano et al. | 109/49.5 |
| 5,087,516 | 2/1992 | Groves | 89/36.02 |

FOREIGN PATENT DOCUMENTS

| | | | |
|---|---|---|---|
| 21532 | 7/1898 | United Kingdom | 89/36.02 |

*Primary Examiner*—Stephen M. Johnson

[57] ABSTRACT

A high performance armor protection system for tank crews and other combat vehicles includes a high performance armor deflection technique for blocking armor piercing weapons. The armor deflection technique utilizes metal balls which are organized in a specific pattern in which the balls are placed in a predetermined number of vertical rows such that a blocking force is generated against armor piercing weapons. The metal balls may be of a predetermined diameter for the purpose of generating a target density and improving the effect of the deflection technique. The deflection technique prevents armor piercing weapons and chemical piercing jets by causing the metal balls to rotate and thereby deflect the kinetic energy of the weapons and to further form a greater target density to stop the weapons. The armor protection system may be disposed around a tank or fighting vehicle in a belted formation for maximum coverage and protection from attack from any possible angle such that the crews and combat personnel operate within a safe and injury free space.

8 Claims, 17 Drawing Sheets

HIGH PERFORMANCE ARMOR PROTECTION SYSTEM FOR TANK CREWS AND FIGHTING VEHICLES

CROSS-REFERENCE TO RELATED APPLICATION

This is a continuation-in-part application of U.S. patent application Ser. No. 08/215,754, filed Mar. 21, 1994, entitled "HIGH PERFORMANCE ARMOR PROTECTION SYSTEM FOR TANK CREWS AND FIGHTING VEHICLES", now abandoned.

BACKGROUND OF THE INVENTION

1. Field of the Invention

This invention relates to tanks and fighting vehicles which utilize protection systems which guard against large caliber armor piercing weapons, for example, chemical weapons and high impact kinetic energy weapons.

2. Related Information

The success of future ground battles will rely heavily on tanks and armored vehicles more than ever because there have been significant improvements in anti-tank guns, missiles, and ammunition. These anti-tank weapons have great speed and accuracy which permits a user to make a first round kill from a long distance. Consequently, tanks and armored vehicles are vulnerable to attack and, therefore, it is critical to guard against such anti-tank weapons.

There are a large variety of lethal weapons capable of use against tanks and other fighting vehicles (including personnel carriers) which have been, and are being, developed. Such weapons include anti-tank missiles which destroy tanks with a chemical piercing jet. These chemical piercing jets may be fired from helicopters (from a long distance), and deployed from a well hidden position such as by foot soldiers or ground positioned vehicles. Other weapons include anti-tank and armor piercing guns which utilize high density piercing rods and high kinetic energy ammunition. These weapons penetrate a tank or fighting vehicle thus killing the crew and destroying the vehicle interior. These weapons are characterized in that they utilize high speed and high impact energy.

Unlike in the past, the psychological shock on an enemy does not obtain when they are presented with a tank or large fighting vehicle because the enemy typically has access to anti-tank weaponry and, therefore, the enemy's fighting will is not diminished simply by employing a tank or the like.

Armor piercing weapons have been improved recently by utilizing high density metal alloys, for example, depleted uranium and tungsten. These materials are extremely dense and enhance the ability of these weapons to pierce thick armored targets.

Further, Tandem Warheads (warheads capable of producing multiple chemical piercing jets) are in use which are able to penetrate the so-called reactive armor (i.e., the outside wall) of a fighting vehicle with a first chemical piercing jet and an inner wall of the fighting vehicle with another chemical piercing jet.

Accordingly, there is a need in the art to overcome the effectiveness of armor piercing weapons in order to ensure the safety of the crews of armor vehicles, thereby minimizing casualties in military operations throughout the world.

SUMMARY OF THE INVENTION

It is an object of the invention to provide improved protection for the personnel of tanks and armored vehicles against armor piercing weapons including kinetic energy weapons (for example, those fired from other tanks and airplanes) and chemical weapons, missiles and heavy ammunition (for example, those fired from helicopters, tanks and foot soldiers using shoulder launchers).

The present invention provides a system which reacts to the penetration force from the piercing energy of a penetrating weapon and converts such piercing energy into a dynamic deflection and pressure maneuver.

In order to overcome the disadvantages of the prior art, an armor protection system of the present invention includes a metal container having a plurality of metal balls arranged in a plurality of horizontal rows where the metal container has an outer wall facing away from a space being protected and the outer wall is a double outer wall having at least a partial void between the outer walls that make up the double outer wall.

BRIEF DESCRIPTION OF THE DRAWINGS

For the purpose of illustrating the invention, there is shown in the drawing forms which are presently preferred, it being understood, however, that the invention is not limited to the precise arrangements and instrumentalities shown.

DETAILED DESCRIPTION OF THE PREFERRED EMBODIMENTS

Figure 1:
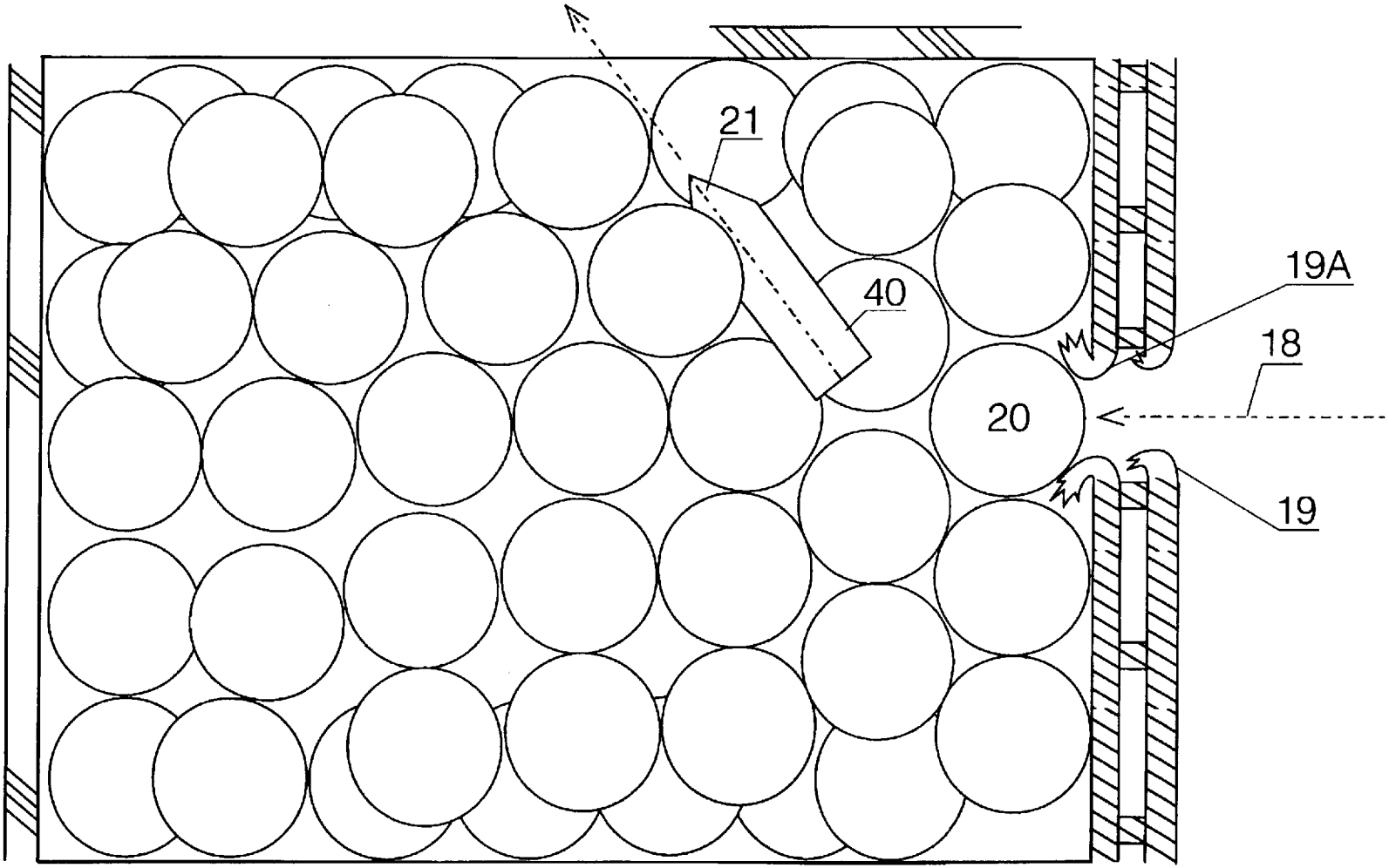
FIG. 1 is a sectional view of a double wall of an armor container in accordance with the invention.

Referring now to the drawings wherein like numerals indicate like elements, there is shown in FIG. 1 a sectional view of a double wall armor container 1 having an outer wall 19 facing away from a tank or armor vehicle (not shown) and a second inter wall 19A disposed behind the outer wall 19 and forming at least a partial void 2 therebetween. The armor container 1 includes a plurality of light weight metal balls 20 which are arranged in a plurality of horizontal rows in a random order and in about seven vertical rows. As may be best seen in FIGS. 3–6, the armor container 1 also includes side, back, top and bottom walls forming an enclosure for the metal balls 20.

An armor container 1 according to the present invention is capable of defeating kinetic energy-type armor piercing weapons. The principle on which the present invention defeats these kinetic energy weapons is based on the dynamic force and pressure which is produced from the interaction of a projectile with the metal balls 20 within the container 1. In particular, the potential energy of a projectile is converted into dynamic pressure via the metal balls which forces the projectile to change course.

Figure 12:
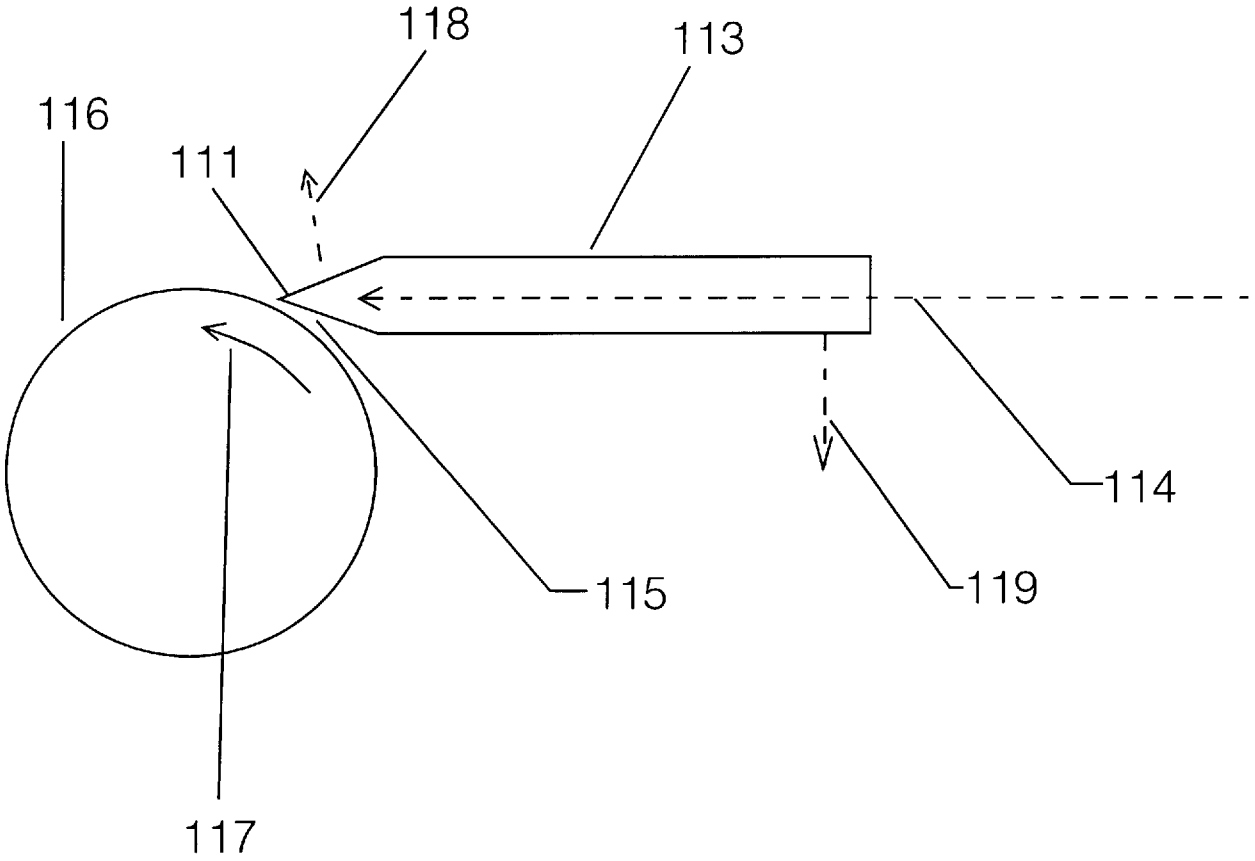
FIG. 12 is a sectional view illustrating the deflection forces experienced between a metal ball and a piercing projectile.

With reference to FIG. 12, a metal ball 116 is capable of producing deflection forces on a projectile 113. In particular, a leading edge 111 contacts the metal ball 116 at location 115 causing the metal ball 116 to spin in a direction indicated by arrow 117, thereby creating a spinning movement which shifts the projectile 113 into a new course 118 over its pitch axis and causing the tail 119 of the projectile 113 to shift downwards.

Therefore, with reference to FIG. 1, a projectile 40 moving on an axis of penetration 18 through outer and inner walls 19, 19A interacts with the metal balls 20 and causes the projectile 40 to deflect from the original axis of penetration 18 to a new path (or axis) 21.

Figure 13:
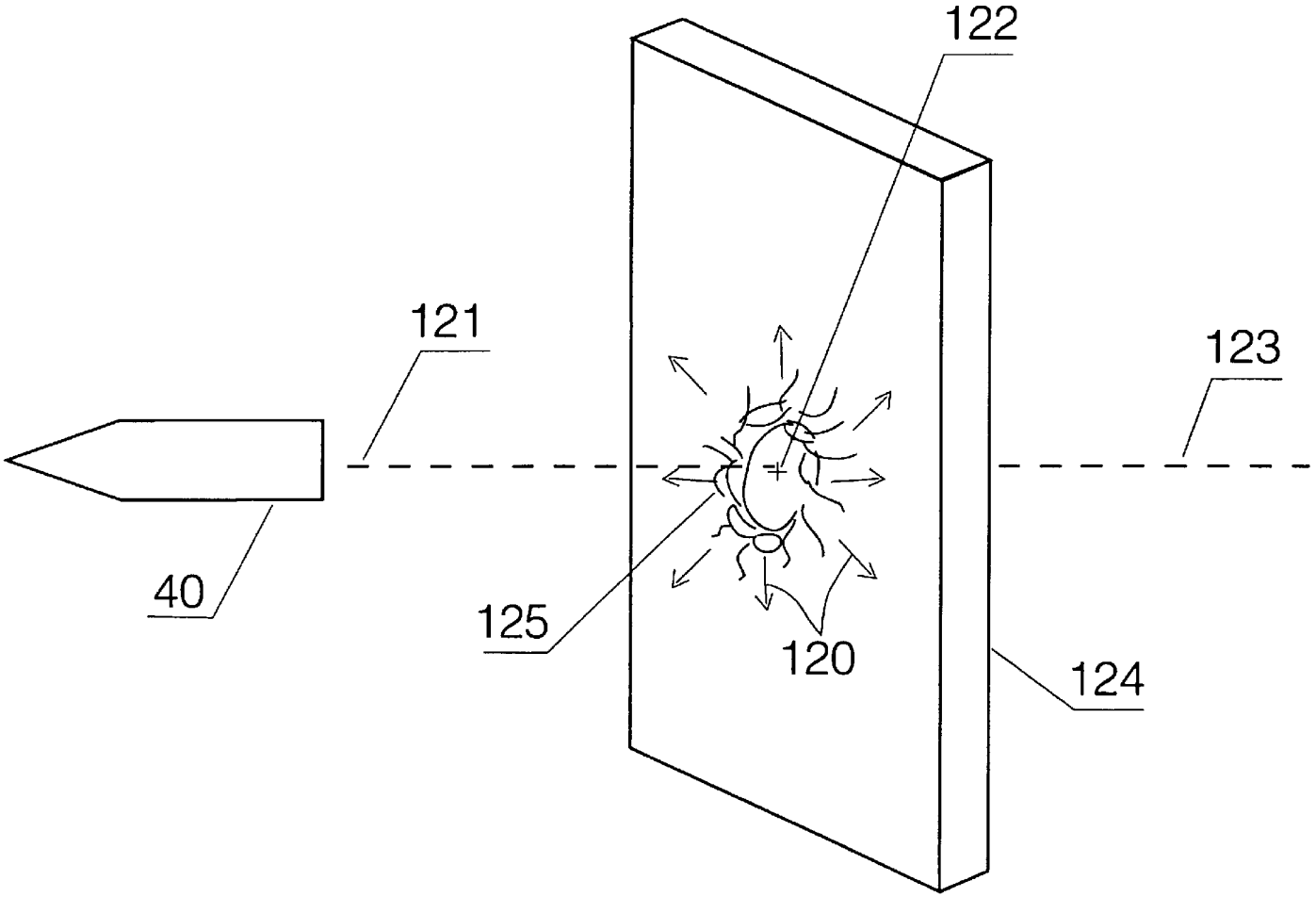
FIG. 13 is a sectional view of an armored plate being pierced by a kinetic energy projectile.

In contrast, FIG. 13 shows a kinetic energy projectile 40 which does not change the direction of its flight path 121 after penetrating an armored plate 124 from the direction of its flight path 123 before penetration of the armored plate 124. This is so because the target material 125 is merely accelerated outward in a 360° pattern 120 from the axis of penetration 122 as the projectile 40 passes through the armored plate 124.

Referring to FIG. 1, it is noted that the double outer wall 19, 19A forming the partial void 2 slows the speed of the kinetic energy projectile 40 and increases its ballistic limit.

Figure 4:
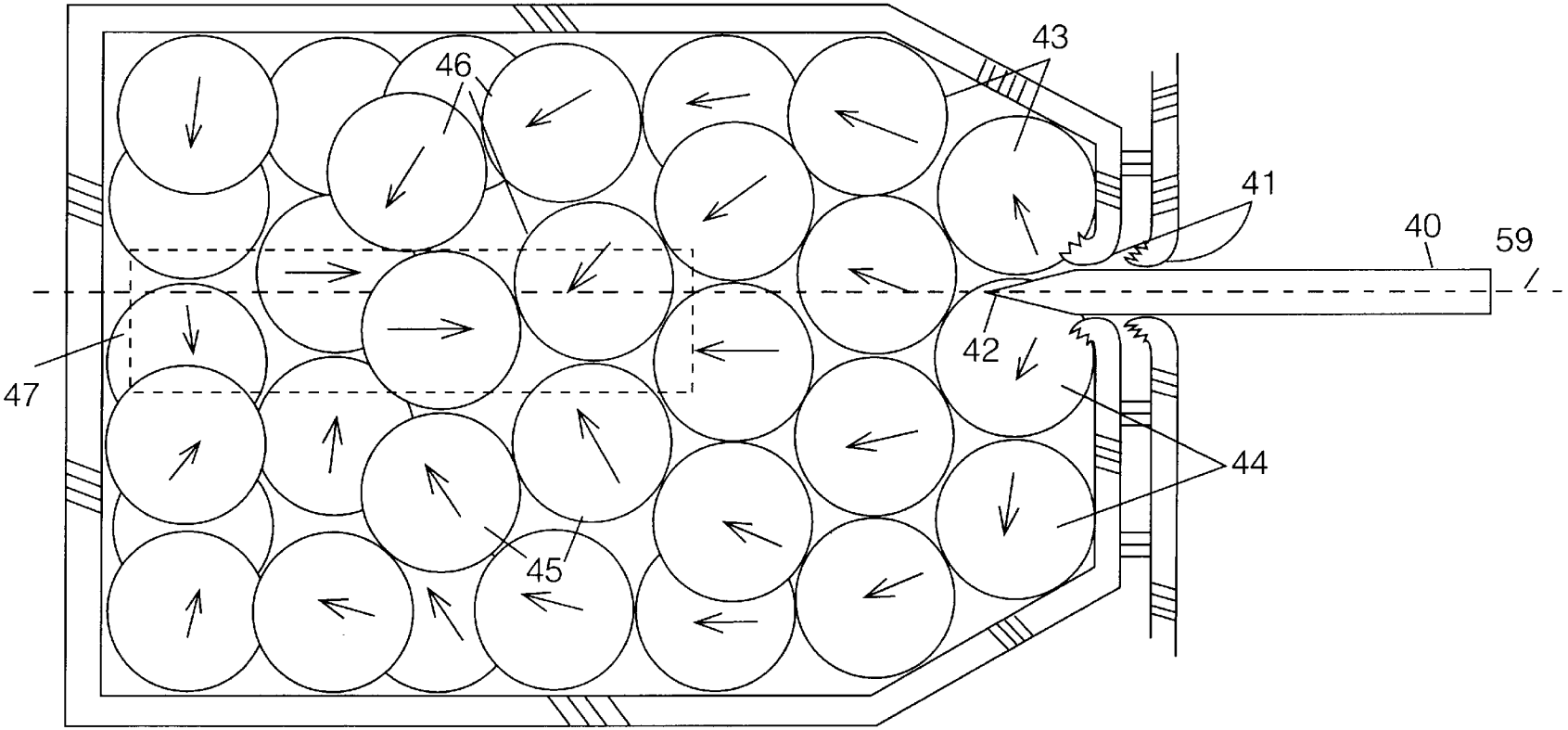
FIG. 4 is a sectional view of a kinetic energy penetrating rod interacting with an armor container in accordance with the invention.
Figure 5:
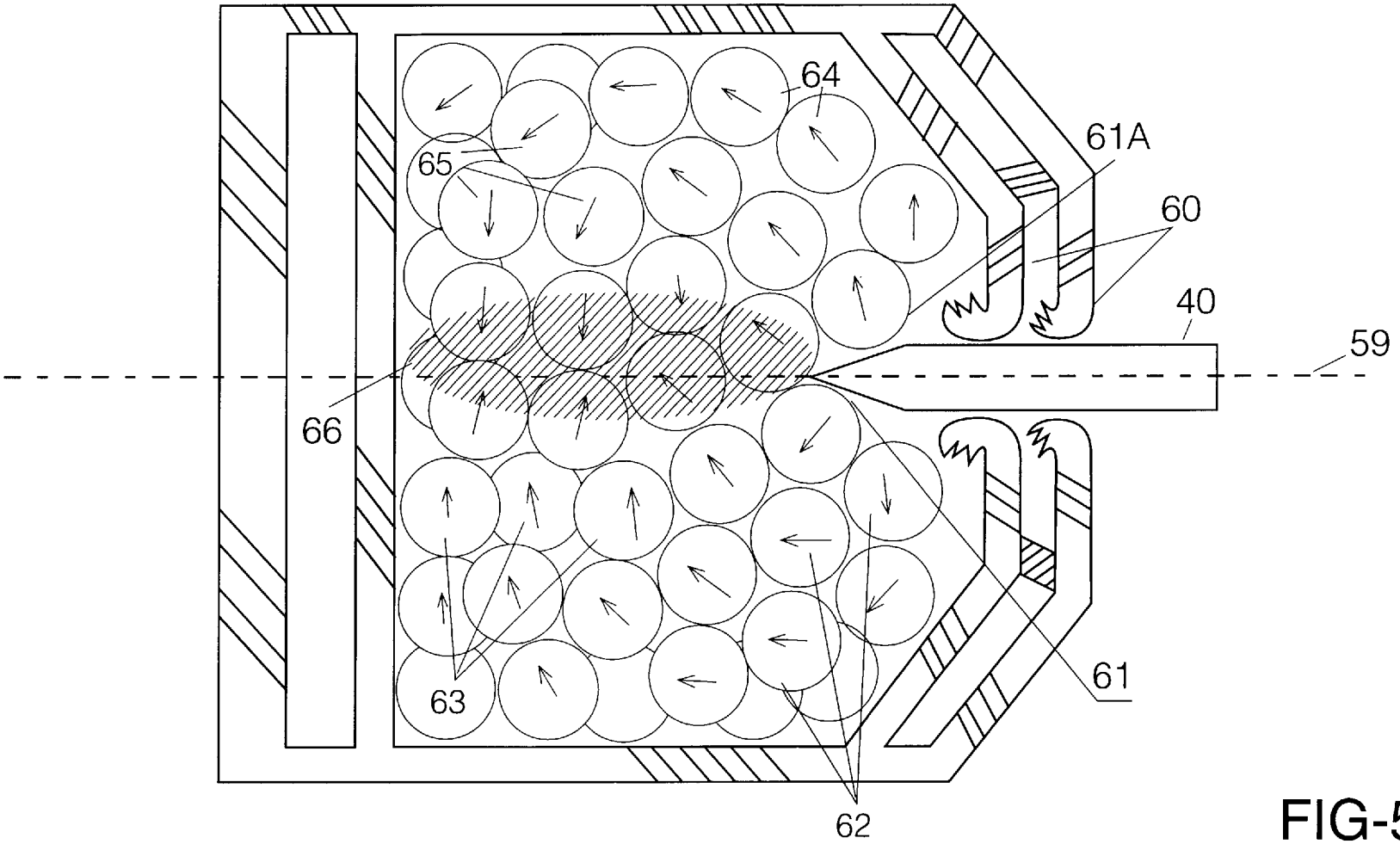
FIG. 5 is a sectional view of the kinetic energy penetrating rod in another stage of penetration.
Figure 6:
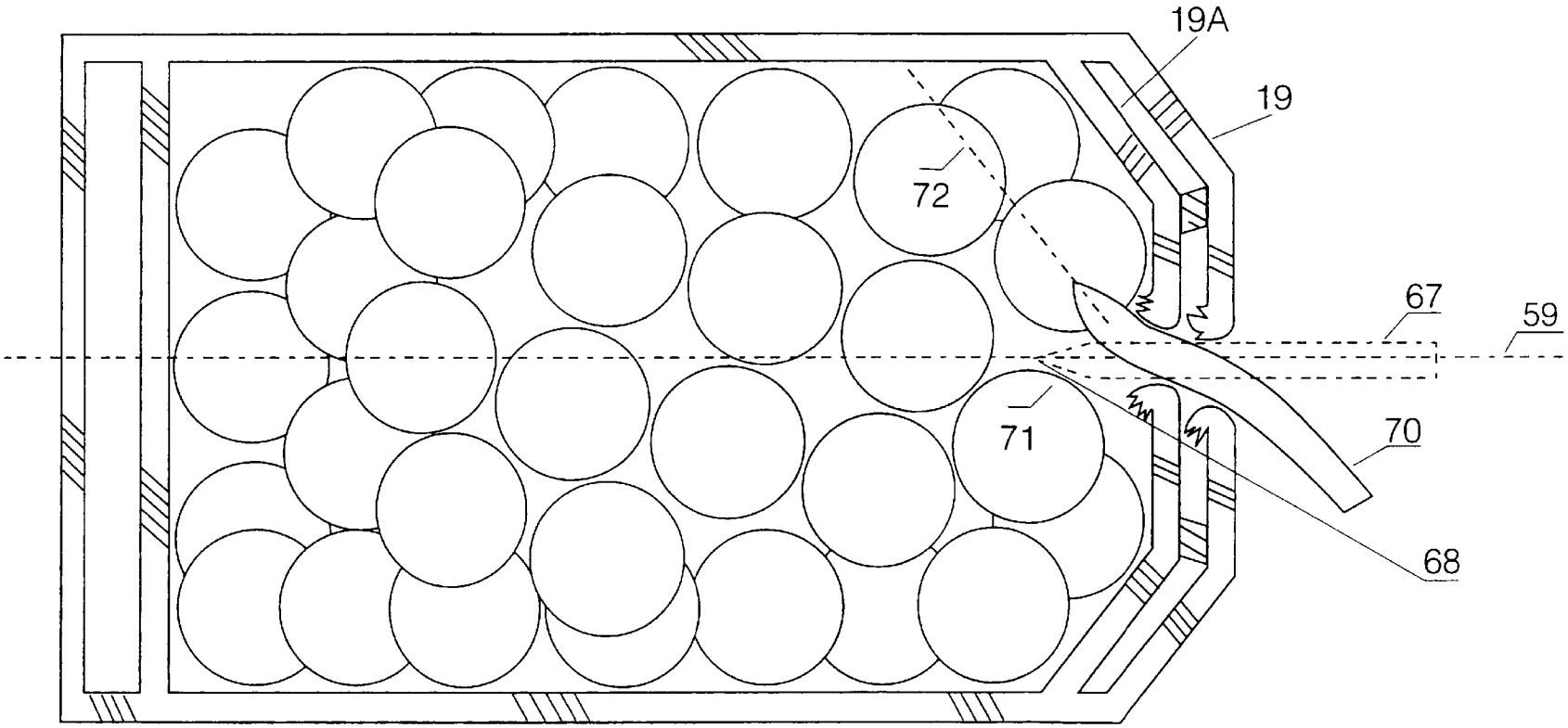
FIG. 6 is a sectional view of an armor container deflecting a kinetic energy projectile.

Reference is now made to FIGS. 4–6 which illustrate details as to the manner in which the armor container 1 changes the axis of penetration of a projectile 40. The projectile 40 passes through the inner and outer walls 19, 19A of the armor container 1 causing a perforation 41 in the walls 19, 19A. The projectile 40 contacts the metal balls 42, 43 and accelerates them towards the rear of the armor container 1. Consequently, rearward metal balls 45, 46 are driven towards the rear of the armor container 1 and are also driven towards the center of the container 1. As a result, an area of higher density 47 is formed along the projectile axis of penetration 59 and opposes the advancement of the projectile 40.

Figure 4A:
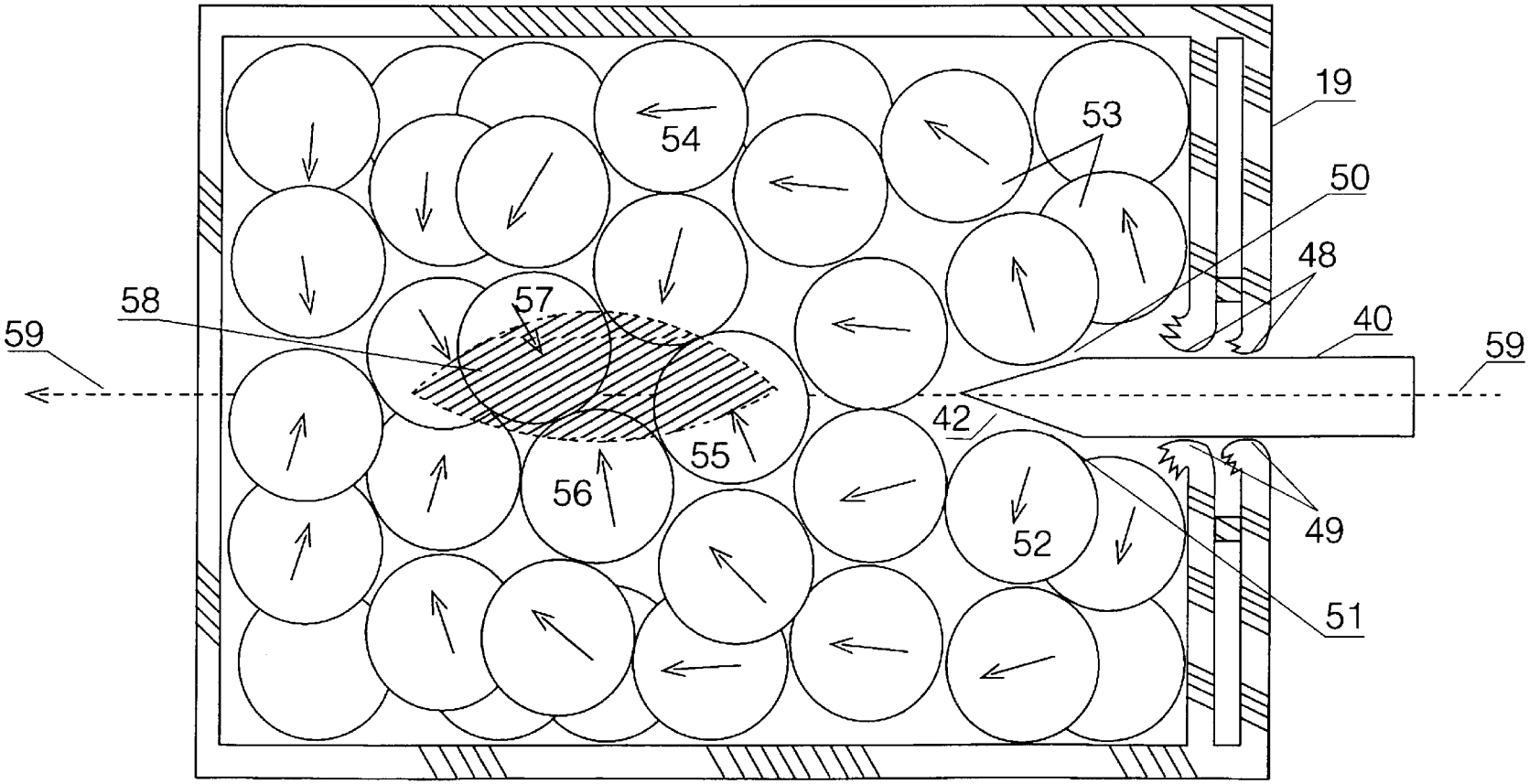
FIG. 4A is a sectional view of the kinetic energy penetrating rod of FIG. 4 in a further stage of penetration.

With reference to FIG. 4A, a projectile 40 perforates the double wall 19, 19A at 48, 49 thereby accelerating the material of the double wall at 48, 49 in a rearward direction. The projectile 40 also interacts with the metal balls at points 50, 51 thereby accelerating the metal balls 52, 53, 54, 55 radially from the projectile axis of penetration 59 and also rearwardly at, for example, 54 such that the metal balls form a location of higher density 58 along the axis of penetration 59. The area of high density 58 acts in an opposite direction than the direction of penetration of the projectile 40 so that the projectile 40 is deflected from the initial axis of penetration 59. Therefore, the armor container 1 protects an area from penetration by the projectile 40.

With reference to FIG. 5, a modification to the armor container 1 is shown. In particular, the container 1 includes a double wall having an outer and inner wall directed towards an incoming projectile 40 where the outer and inner walls form at least one oblique wall section with respect to the projectile axis of penetration 59. The container 1 also includes a double rear wall having an inner wall and outer wall separated by at least a partial void. As was the case with respect to FIGS. 4 and 4A, the projectile 40 causes the metal balls 62, 63, 64, 65 to accelerate radially, rearwardly and centrally such that an area of higher density 66 is produced along the projectile axis of penetration 59.

With reference to FIG. 6, the interaction of the incoming projectile 67 and the metal balls 71 may cause the typically conical leading edge 68 of the projectile 70 to shift into a new flight path 72 via its pitch axis. The sudden change in direction from the axis of penetration 59 to the new direction 72 may cause the projectile 70 to deform, thereby losing its aerodynamic shape and possibly breaking up or becoming trapped within the armor itself.

It is preferred that the metal balls are of a light weight and have a smooth surface, it being most preferred that the metal balls are formed of titanium or magnesium (which materials are capable of withstanding high levels of pressure without breaking apart or becoming deformed). Titanium and magnesium are also relatively light materials thereby eliminating excessive additional weight to a tank or fighting vehicle which would otherwise negatively affect maneuverability.

Figure 16:
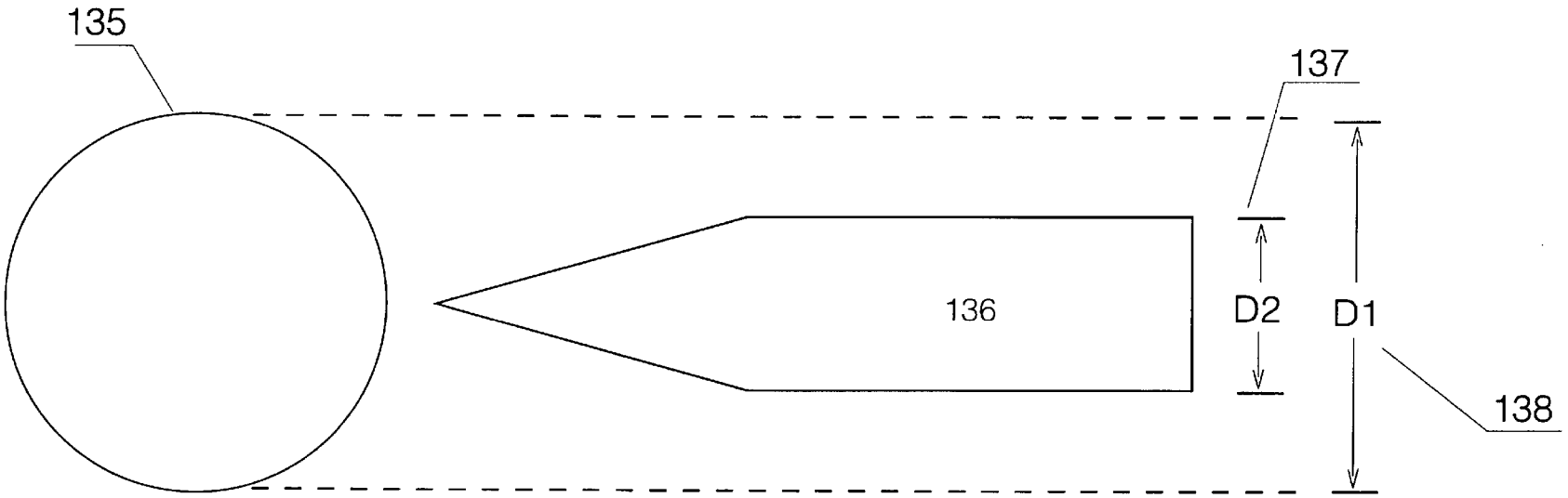
FIG. 16 is a sectional view showing the relative difference between the diameters of a metal ball and a kinetic energy piercing rod in accordance with the invention.

With reference to FIG. 16, it is preferred that the diameter D1 of a metal ball 135 be larger than the diameter D2 of a piercing rod 136 of a projectile. This is so because, with reference to FIG. 4, once the projectile 40 pierces the inner and outer walls 19, 19A of the armor container 1, the relatively larger sized metal balls 52, 53 cannot escape the container 1. This ensures proper projectile 40 deflection performance and creation of the critical higher density area 58 to oppose the projectile 40. Indeed, if the metal balls 52, 53 are of a diameter D1 which is about the same diameter as the projectile diameter D2then the metal balls 52, 53 may escape from the container 1 through the hole left in the inner and outer walls 19, 19A from the projectile 40.

It is highly preferred that the metal balls be of a diameter between about 55 to 80 mm in diameter (a size which is presently larger than existing kinetic energy projectiles).

Reference is now made to FIGS. 2–3 and 14–15 which show how the present invention is capable of defeating chemical armor piercing weapons.

Figure 14:
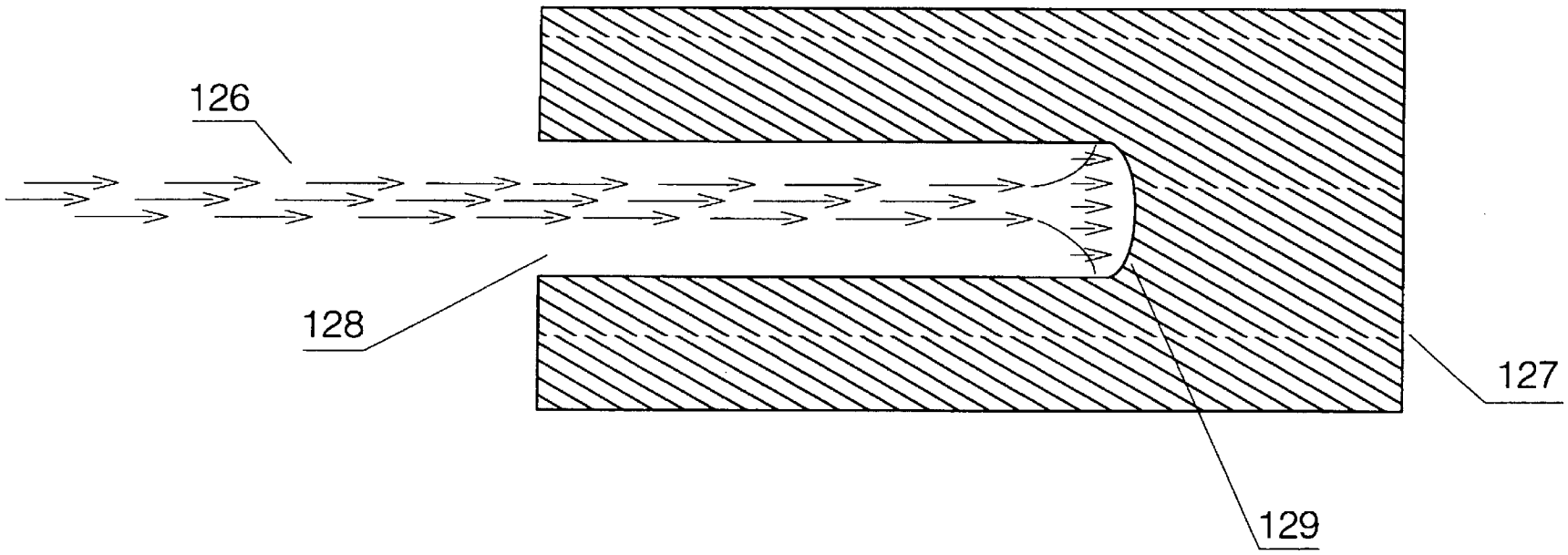
FIG. 14 is a sectional view showing a piercing jet penetrating an armored plate.
Figure 15:
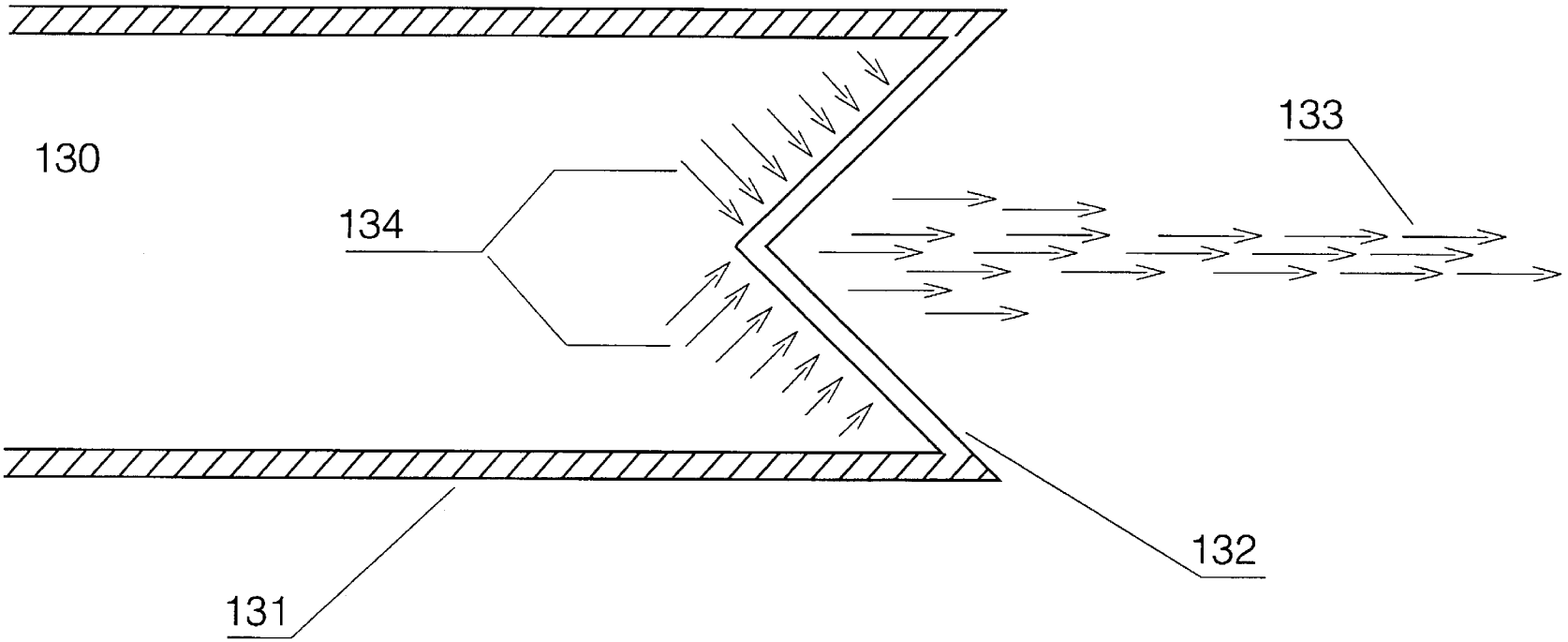
FIG. 15 is a sectional view showing how a piercing jet is produced.

With reference to FIGS. 14 and 15, a chemical weapon 131 includes a shaped charge 130. The shaped charge 130 produces a direction of shock 134 which interacts with a melting liner 132 such that the shock 134 collapses the melting liner 132 and produces a piercing jet 133 which is capable of piercing an armored plate 127 (FIG. 14). The explosive nature of the chemical armor piercing weapon produces an extremely high temperature and high pressure melting stream of particles (or jet) 133 that travels at high speed and extremely high pressure. When the jet 133 contacts an armored plate 127, it is capable of melting even reinforced, thick cement and/or steel walls. The jet 133 forms a cavity 128 having a leading edge 129 as the jet 133 advances through the armored plate 127. The cavity 128 typically measures from about 3 to 5 mm in diameter through a typical armored plate 127.

Figure 2:
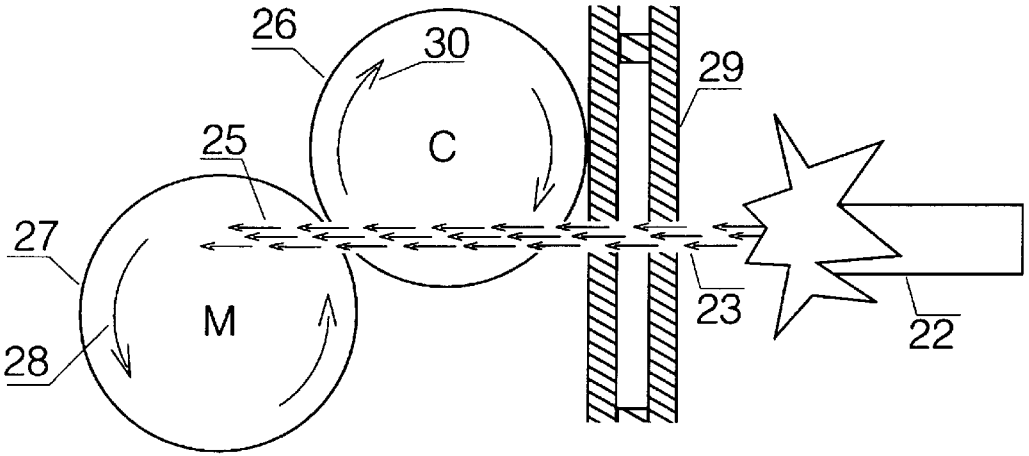
FIG. 2 is a sectional view of a chemical armor piercing weapon penetrating an armor container in accordance with the invention.
Figure 2A:
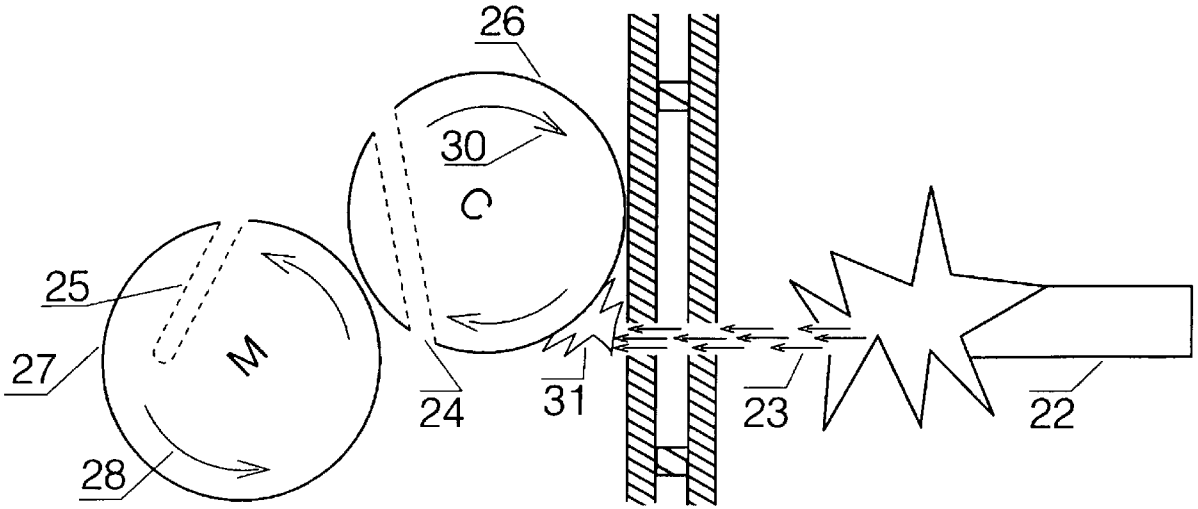
FIG. 2A is a sectional view showing the deflection of the chemical armor piercing weapon shown in FIG. 2.
Figure 3:
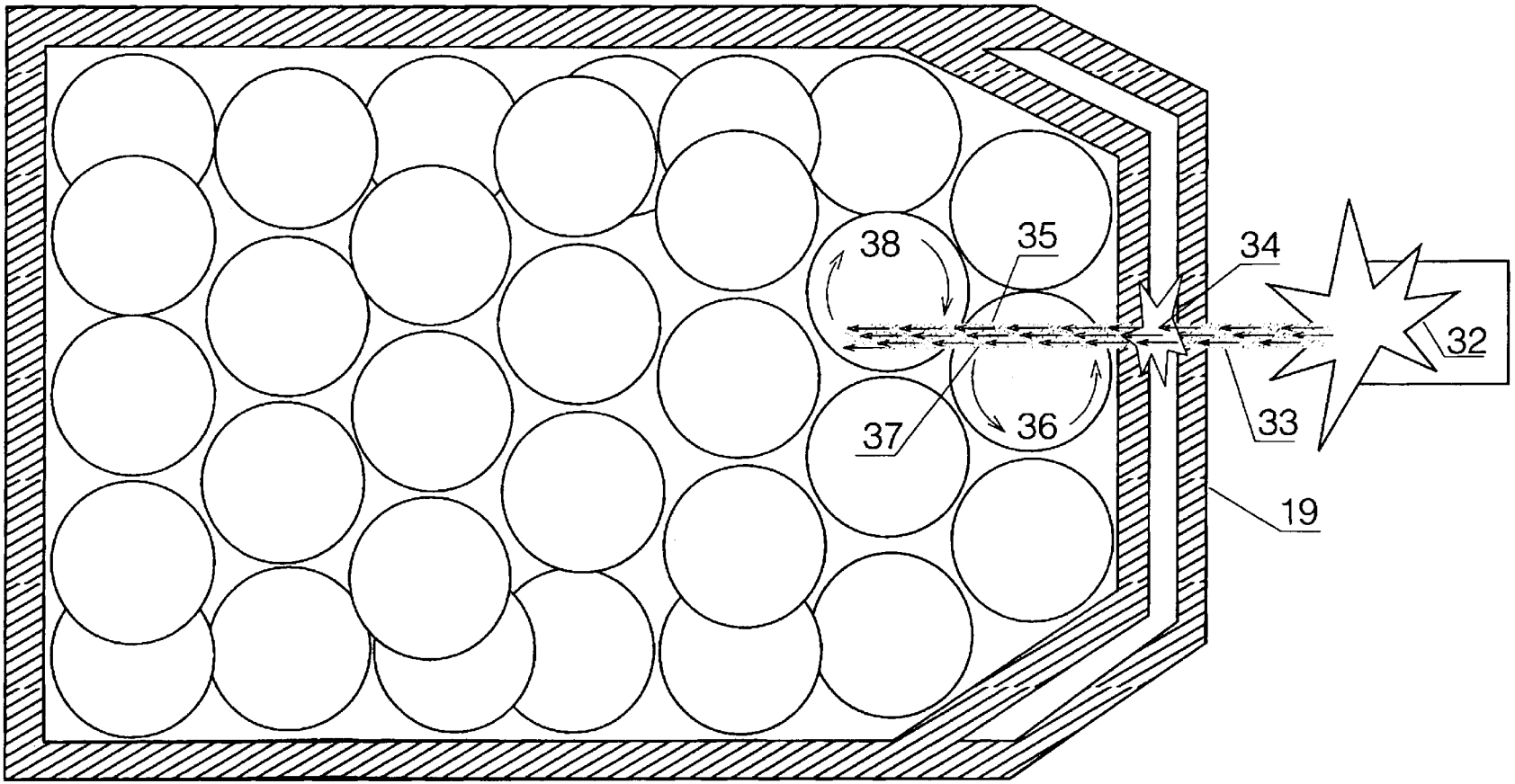
FIG. 3 is another sectional view of a chemical armor piercing weapon interacting with an armor container in accordance with the invention.

With reference to FIGS. 2–3, the principle upon which the present invention defeats chemical armor piercing weapons is based on converting the energy of the piercing jet 23 into kinetic energy which acts upon the metal balls 26, 27 causing them to spin about their centers of gravity, thereby breaking the direct line of the piercing jet 23 by interrupting the perforation by the piercing jet 23.

With reference to FIGS. 2 and 3, an anti-tank (or anti-fighting vehicle) chemical armor piercing weapon 22 produces an armor piercing jet 23. The armor piercing jet 23 advances through the outer and inner wall 19, 19A of the container 1 and then begins to advance through metal balls 26, 27, causing either full penetration at location 24 and/or partial penetration at location 25. The advancement of the piercing jet 23 through the metal balls 26, 27 causes the metal balls to spin in directions shown by arrows 28, 30. The metal balls 26, 27 spin about there center location C (or center of gravity M). Consequently, the axial orientation of the cavities 24, 25 are disrupted by the spinning of the metal balls 26, 27. Thus, the direct axial advancement of the piercing jet 23 is interrupted and perforation of the cavity 1 is prevented.

It is noted that the pressure momentum of the piercing jet 23 applied to the off-center locations 24, 25 of the metal balls 26, 27 enhances the spinning of the metal balls 26, 27 and may cause the metal ball 26 to rotate clockwise 30 while metal ball 27 rotates counter-clockwise 28, thereby enhancing the interruption of perforation by the piercing jet 23. Consequently, the piercing jet 23 is interrupted at position 31.

FIG. 3 shows an armor container 1 having outer and inner walls 19, 19A which are perforated by a chemical weapon piercing jet 33 causing metal balls to rotate in directions 36, 38 when the piercing jet 33 penetrates the metal balls at 35 and 37. The spinning of the metal balls 35, 37 interrupts the piercing action of the piercing jet 33.

Figure 7:
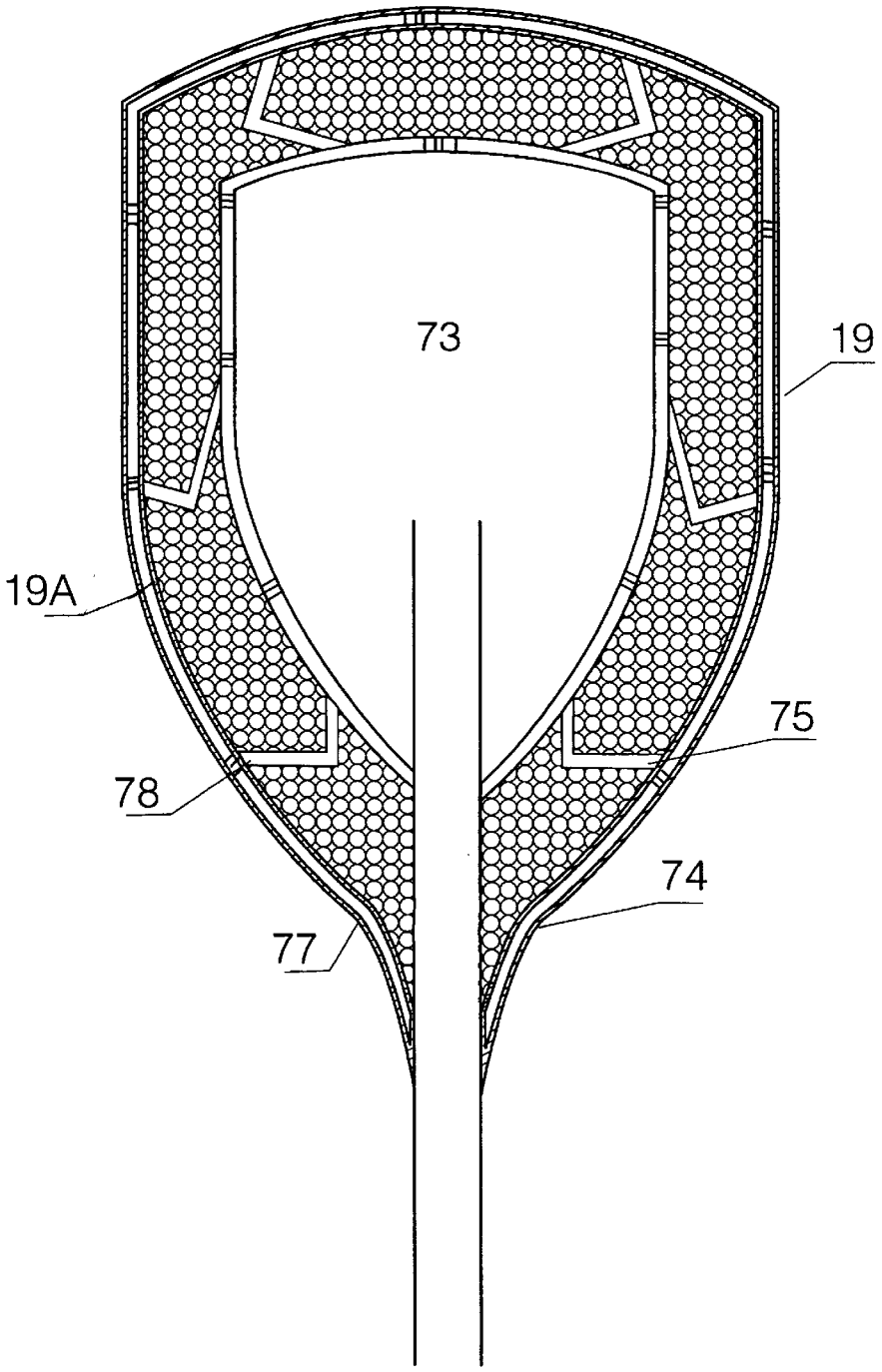
FIG. 7 is a top view showing an armor container in accordance with the invention disposed around a tank turret.

Reference is now made to FIG. 7 which shows a top view of a tank turret 73 utilizing armor containers according to the present invention. An organized pattern of armor containers 74, 77 are disposed around the tank turret 73. Partitions 75, 78 divide the armor containers 74, 77 thereby maintaining target density if one of the armor containers is badly damaged and the metal balls of that container begin to escape. Indeed, if a particular armor container is devoid of a substantial number of metal balls, the tank (or armored vehicle) will be susceptible to penetration. The partitions 75, 78, however, insure that other areas of the turret 73 (or other parts of a fighting vehicle) remain well protected despite a failure of a particular armor container.

Figure 8:
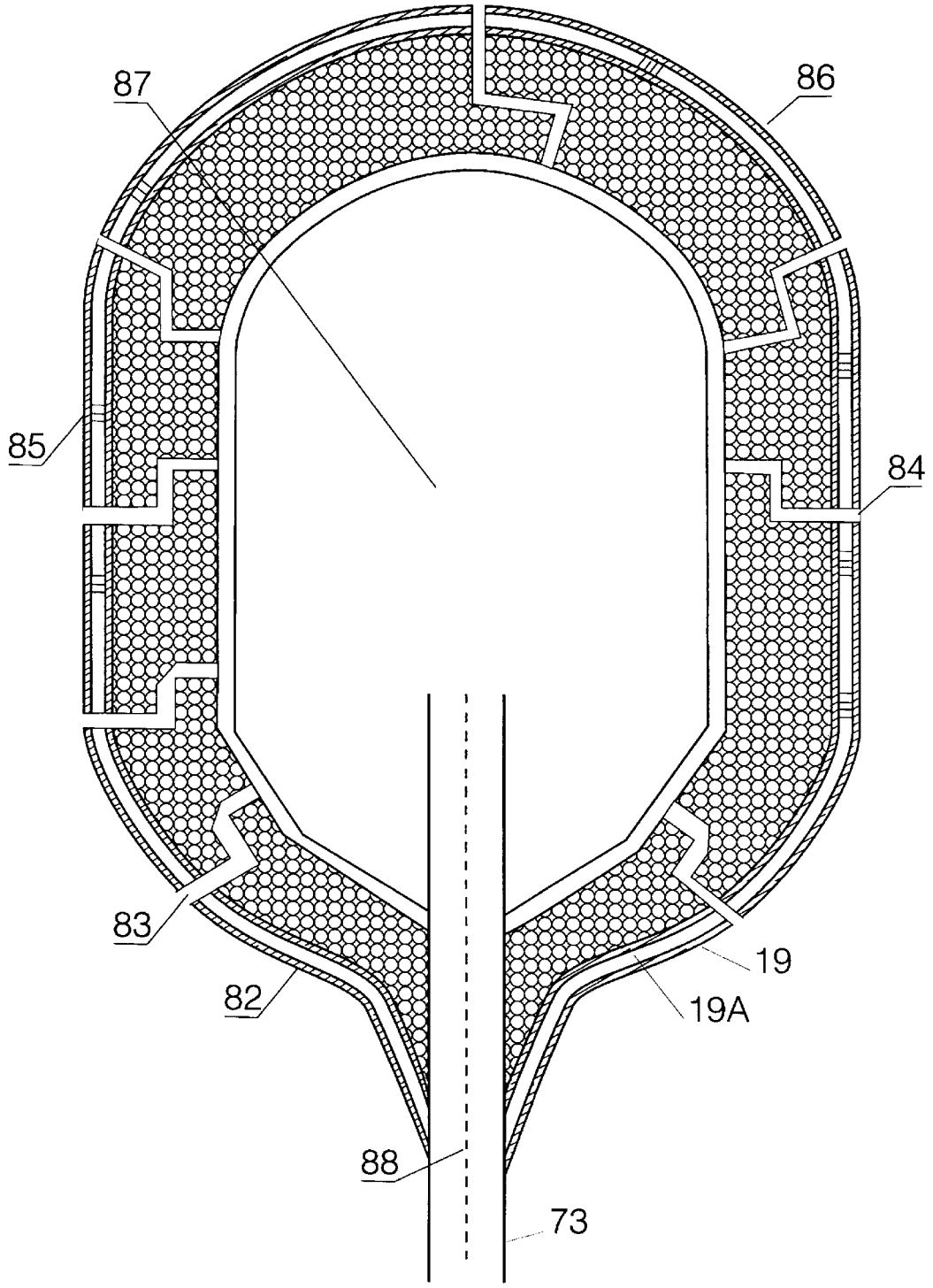
FIG. 8 is a top sectional view of another armor container in accordance with the invention disposed around a tank turret.

Reference is now made to FIG. 8 which shows an alternative organized pattern of armor containers surrounding a tank turret 87. The pattern of armor containers surrounds the tank turret in a 360° pattern. Narrow void spaces 83, 84 partition armor containers 85, 86 such that target density is maintained despite that one or more other containers may become badly damaged such that a substantial number of metal balls escape from the damaged container. The tank cannon 73 is overlapped by extended armor sections 81, 82 to protect the cannon 73 from projectiles which may approach the turret from a frontal direction having a narrow angle in relation to the cannon axis 88.

Figure 9:
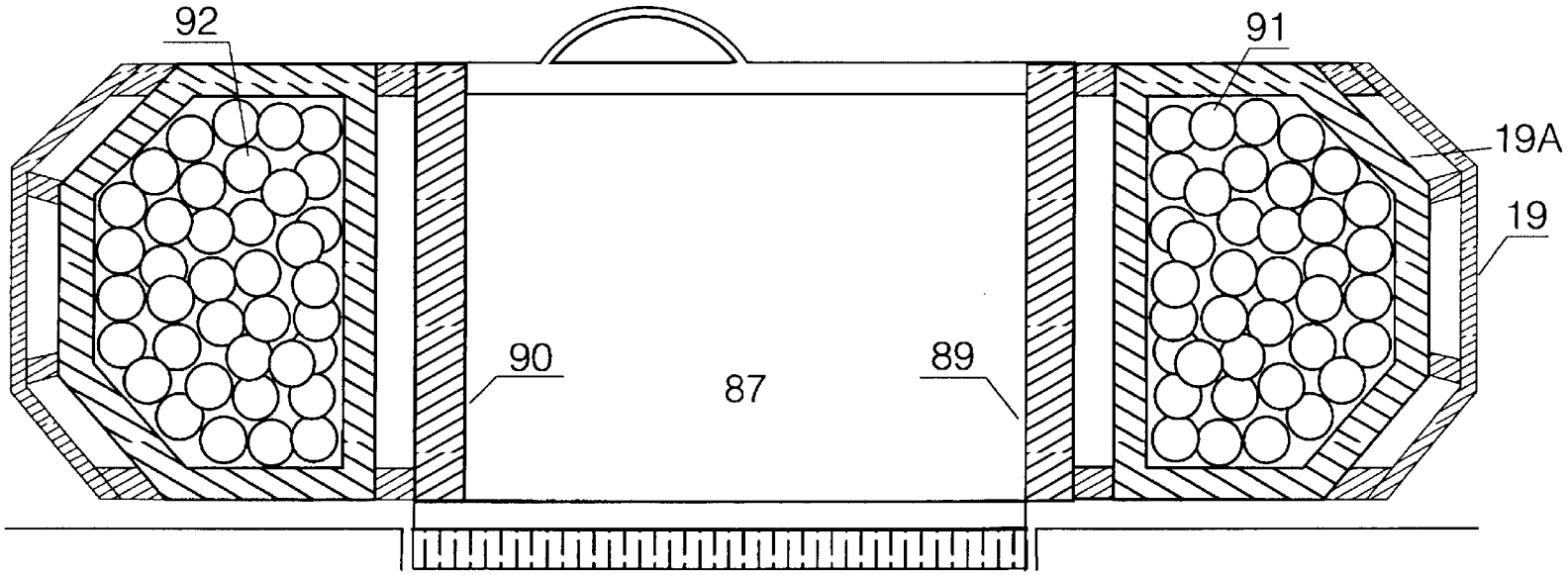
FIG. 9 is a sectional view of armor containers in accordance with the invention disposed around a turret.

With reference to FIG. 9, a tank turret 87 is equipped with armor containers 91, 92 having double outer walls 19, 19A for deflecting kinetic energy projectiles. Turret walls 89, 90 support the armor containers 91, 92 in appropriate positions.

Figure 10:
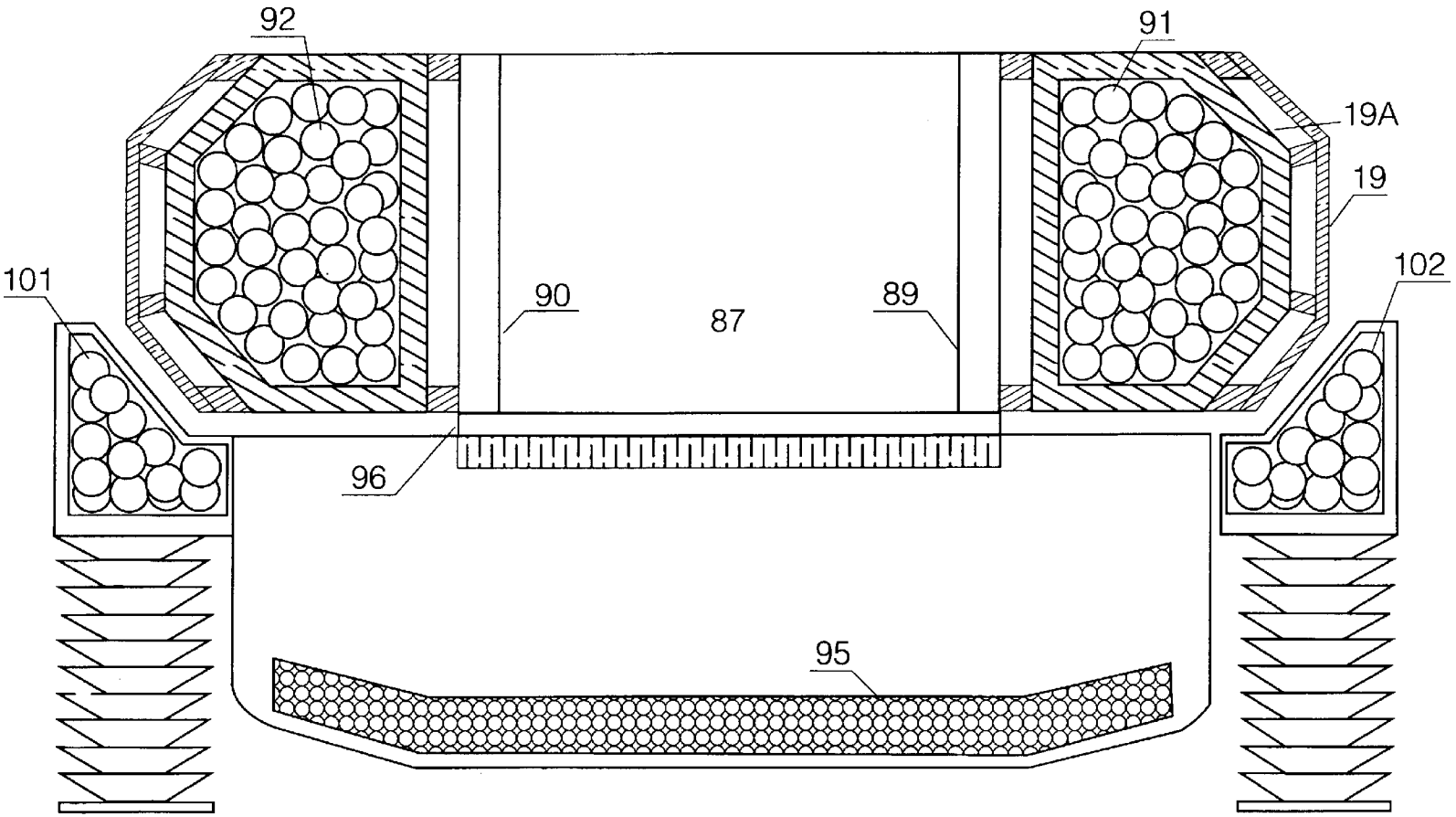
FIG. 10 is a sectional view of armor containers in accordance with the invention disposed around a tank.

FIG. 10 shows a tank having a complete set of armor containers disposed in critical positions to protect the tank from catastrophic damage. A particularly vulnerable location on a tank is the tank turret ring 96. In accordance with the invention, armored sections 101, 102 are designed to protect the turret ring 96. As shown, armored sections 101, 102 include a base section and an oblique upwardly and outwardly extending section which is operatively shaped to protect the turret ring 96. An armored floor 95 is disposed on a bottom portion of the tank to protect the tank and tank crew from damage due to land mines and land mines which may employ armor piercing jets or projectiles. It is noted that the armored floor 95 may be employed on other types of fighting vehicles without departing from the scope of the invention.

It is noted that the armor containers in accordance with the invention may be installed on existing tanks in a retrofit application or may be incorporated into a tank design (or other fighting vehicle design) in its early stages such that the tank is manufactured with the armor containers from the beginning.

Figure 11:
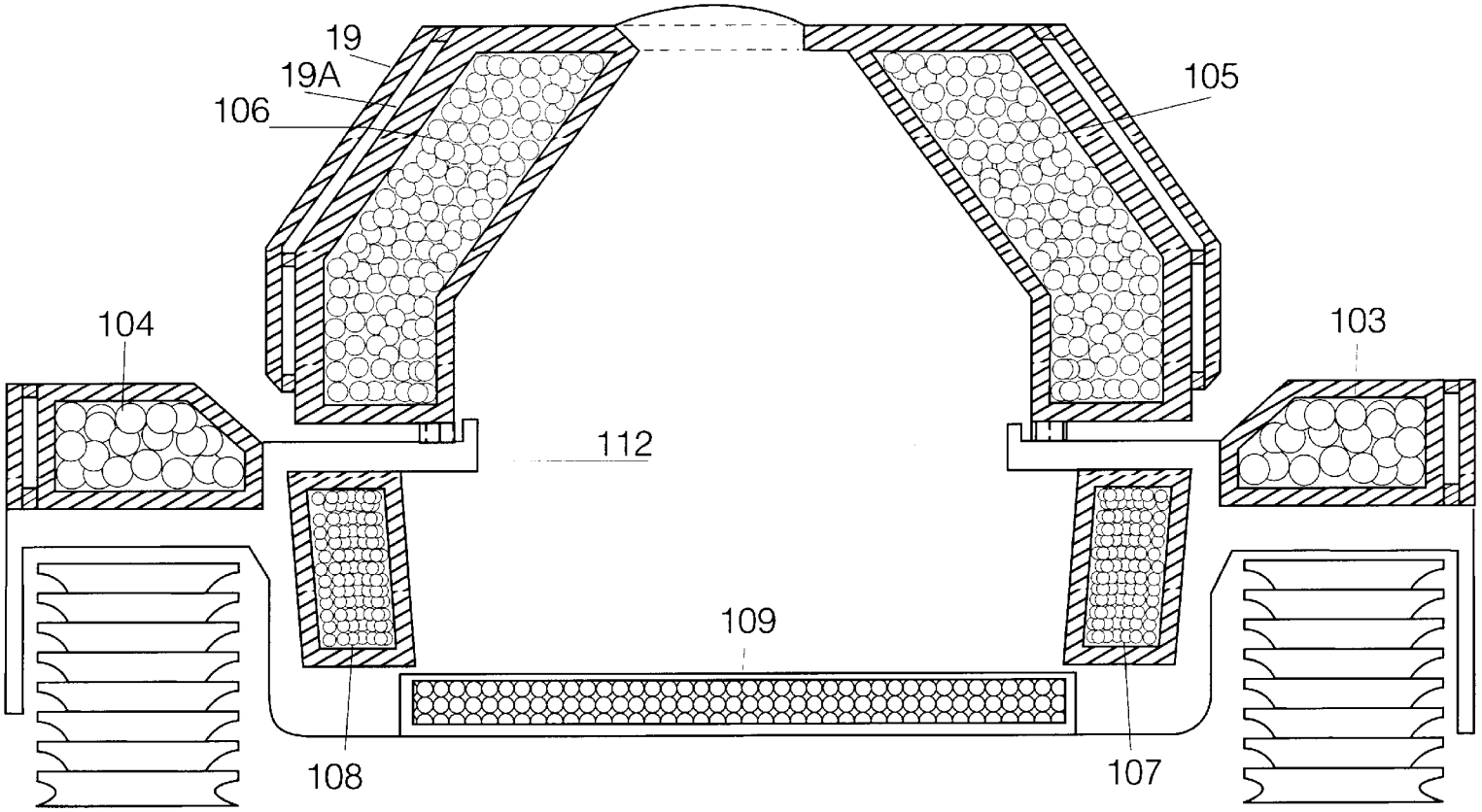
FIG. 11 is a sectional view of armor containers in accordance with the invention which are adapted to be disposed on tanks already in service (via retrofit)

With reference to FIG. 11, and alternative orientation of armor containers is shown. In particular, armor containers 103, 104 are shaped and positioned to protect the turret ring 112 of a tank. Armor containers 107, 108 are shaped and positioned to protect the tank hull and armor container 109 is positioned in a bottom portion of the tank to protect the tank from land mines. Armor containers 105, 106 include inner and outer walls 19, 19A and are shaped and positioned to protect the tank turret.

As is apparent to one skilled in the art from the above teaching and with reference to FIGS. 9–11, the armor containers are shaped and positioned to surround a tank and/or fighting vehicle such that protection of the vehicle is obtained against projectiles incident from any direction. Thus, when the fighting vehicle is a tank, a first arrangement of armor containers is disposed around the tank turret to protect the turret from incident projectiles. A second arrangement of armor containers is positioned (or embedded) about the tank, for example, to protect the turret ring of the tank. A third arrangement of armor containers is preferably disposed in a bottom portion of the tank to protect the tank against land mines. Thus, the tank is protected against projectiles from any possible direction during combat.

Advantageously, the armor containers of the present invention include a double outer wall and other inner walls forming an enclosure which is filled with metal balls organized in such a way that they resist and deflect projectiles incident on the armor container. The invention as disclosed hereinabove will enable a tank or other fighting vehicle to survive a substantial number of direct hits from armored piercing weapons. Further, according to the present invention, a fighting vehicle may be protected from land mines that would possibly penetrate the bottom of a vehicle by disposing armor containers in a bottom portion of the vehicle.

The foregoing description of the preferred embodiments of the present invention have been provided for the purposes of illustration and description. It is not intended to be exhaustive or to limit the invention to the precise forms disclosed. Many modifications and variations are possible in light of the above teaching. It is intended that the scope of the invention be limited not by this detailed description, but rather by the claims appended hereto.

I claim:

1. An armor protection system for protecting a tank having a turret comprising:

a first arrangement of contained metal balls disposed around the turret to substantially surround the turret;

a second arrangement of contained metal balls located in a bottom portion of the tank; and a third arrangement of contained metal balls located adjacent a location where the turret attaches to a remainder of the tank, said first, second and third arrangements of contained metal balls each including a metal container having outer and inner walls forming at least a partial void therebetween, the contained metal balls being disposed within the metal containers.

2. The armor protection system of claim 1 wherein the metal balls of the first, second and third arrangements are selected from the group consisting of titanium balls and magnesium balls.

3. The armor protection system of claim 1 wherein the metal balls have a diameter in the range of about 55 to 80 mm.

4. The armor protection system of claim 1, wherein the armor protection system is adapted to protect the tank from a piercing weapon having a first diameter, the metal balls having a second diameter larger than the first diameter.

5. An armor protection system for protecting a fighting vehicle from an armor piercing weapon comprising:

a container located on the fighting vehicle having an outer wall directed substantially toward the piercing weapon, a rear wall spaced away from the outer wall, and side walls communicating with the outer and rear walls to form an enclosure; and a plurality of metal balls disposed within the enclosure, the walls of the container being shaped such that some of the metal balls move toward the rear wall and some of the metal balls move centrally to form an area of high density of metal balls in response to the piercing weapon piercing the outer wall and entering the enclosure along a first axial direction, the area of high density forming at a position which is axially oriented with the first axial direction, thereby opposing the piercing weapon and causing the piercing weapon to travel along a second axial direction.

6. The armor protection system of claim 5, wherein the enclosure and metal balls are adapted to cause at least some of the metal balls to spin in response to the piercing weapon piercing the outer wall such that energy of the piercing weapon is reduced.

7. The armor protection system of claim 5, wherein the piercing weapon has a first diameter and the metal balls have a second diameter, the second diameter being larger than the first diameter.

8. The armor protection system of claim 5, comprising at least two metal containers separated by partitions such that when one of the metal containers loses a substantial number of metal balls, the other metal container remains substantially capable of protecting the fighting vehicle from the piercing weapon.

* * * * *